US010840653B2

(12) United States Patent
Shibata et al.

(10) Patent No.: US 10,840,653 B2
(45) Date of Patent: Nov. 17, 2020

(54) ELECTRIC DEVICE AND WIRING CABLE

(71) Applicant: HONDA MOTOR CO., LTD., Tokyo (JP)

(72) Inventors: Kenji Shibata, Wako (JP); Tetsuya Matsuhisa, Wako (JP); Yasunori Yamamoto, Wako (JP); Yasuhiro Nakada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/594,560

(22) Filed: Oct. 7, 2019

(65) Prior Publication Data

US 2020/0169048 A1 May 28, 2020

(30) Foreign Application Priority Data

Nov. 27, 2018 (JP) ..... 2018-221659

(51) Int. Cl.
*H01R 13/703* (2006.01)
*H01R 13/447* (2006.01)
*H01R 27/00* (2006.01)

(52) U.S. Cl.
CPC ..... *H01R 13/703* (2013.01); *H01R 13/447* (2013.01); *H01R 27/00* (2013.01)

(58) Field of Classification Search
CPC ..... H01R 13/447
See application file for complete search history.

(56) References Cited

U.S. PATENT DOCUMENTS

| | | | | |
|---|---|---|---|---|
| 10,348,097 | B2 | 7/2019 | Shibata et al. | |
| 2014/0312695 | A1* | 10/2014 | Czarnecki ..... | H01R 13/447 307/41 |
| 2018/0287391 | A1 | 10/2018 | Shibata et al. | |

FOREIGN PATENT DOCUMENTS

| | | | |
|---|---|---|---|
| JP | H10-50388 | A | 2/1998 |
| JP | 2014-99265 | A | 5/2014 |
| JP | 2018-170861 | A | 11/2018 |

* cited by examiner

*Primary Examiner* — Ross N Gushi
(74) *Attorney, Agent, or Firm* — Thomas Horstemeyer, LLP

(57) ABSTRACT

An electric device includes a first receptacle to which a first plug is connected, a second receptacle to which a second plug is connected, and a cover member configured to open/close the second receptacle. In a state in which the first plug is connected to the first receptacle, opening of the cover member is restricted by interference between the first plug and the cover member. In a state in which the second plug is connected to the second receptacle, connection of the first plug to the first receptacle is restricted by interference between the first plug and the cover member.

5 Claims, 10 Drawing Sheets

ELECTRIC DEVICE AND WIRING CABLE

CROSS-REFERENCE TO RELATED APPLICATION(S)

This application claims priority to and the benefit of Japanese Patent Application No. 2018-221659 filed on Nov. 27, 2018, the entire disclosure of which is incorporated herein by reference.

BACKGROUND OF THE INVENTION

Field of the Invention

The present invention relates to an electric device and a wiring cable.

Description of the Related Art

In order to improve safety of a power connector, a structure including a member which covers a receptacle is proposed (Japanese Patent Laid-Open No. 2014-99265 and 10-50388). On the other hand, a technique of connecting a plurality of power generators in series with each other to output a higher voltage is also proposed (Japanese Patent Laid-Open No. 2018-170861).

Assuming an arrangement including a series connection receptacle in a power generator as an arrangement for connecting a plurality of power generators in series with each other, if simultaneous use of this receptacle and a power output receptacle of the power generator for an electric load is not expected in design, a mechanism for avoiding the simultaneous use is preferable. For example, if use of an electric load connection receptacle at the time of series connection to the power generator and an electric load connection receptacle at the time of single use is employed, the above also applies to the simultaneous use of the above two receptacles.

SUMMARY OF THE INVENTION

It is an object of the present invention to provide a technique of restricting the simultaneous use of two receptacles.

According to an aspect of the present invention, there is provided an electric device comprising: a first receptacle to which a first plug is connected; a second receptacle to which a second plug is connected; and a cover member configured to open/close the second receptacle, wherein in a state in which the first plug is connected to the first receptacle, opening of the cover member is restricted by interference between the first plug and the cover member, and in a state in which the second plug is connected to the second receptacle, connection of the first plug to the first receptacle is restricted by interference between the first plug and the cover member.

According to another aspect of the present, there is provided a wiring cable connected to an electric device, wherein the electric device comprises a first receptacle to which a first plug is connected, a second receptacle to which a second plug is connected, and a cover member configured to open/close the second receptacle, in a state in which the first plug is connected to the first receptacle, opening of the cover member is restricted by interference between the first plug and the cover member, and in a state in which the second plug is connected to the second receptacle, connection of the first plug to the first receptacle is restricted by interference between the first plug and the cover member, and the wiring cable comprises a first plug, the first plug includes a projecting portion projecting in a direction crossing a connection direction of the first plug with respect to the first receptacle, the cover member is supported pivotally about a pivotal shaft in a direction along a wall surface on which the second receptacle is arranged, and the projecting portion is located on a pivotal locus of the cover member in a state in which the first plug is connected to the first receptacle.

Further features of the present invention will become apparent from the following description of exemplary embodiments (with reference to the attached drawings).

DESCRIPTION OF THE EMBODIMENTS

First Embodiment

<Structure of Electric Device and Wiring Cable>

Figure 1:
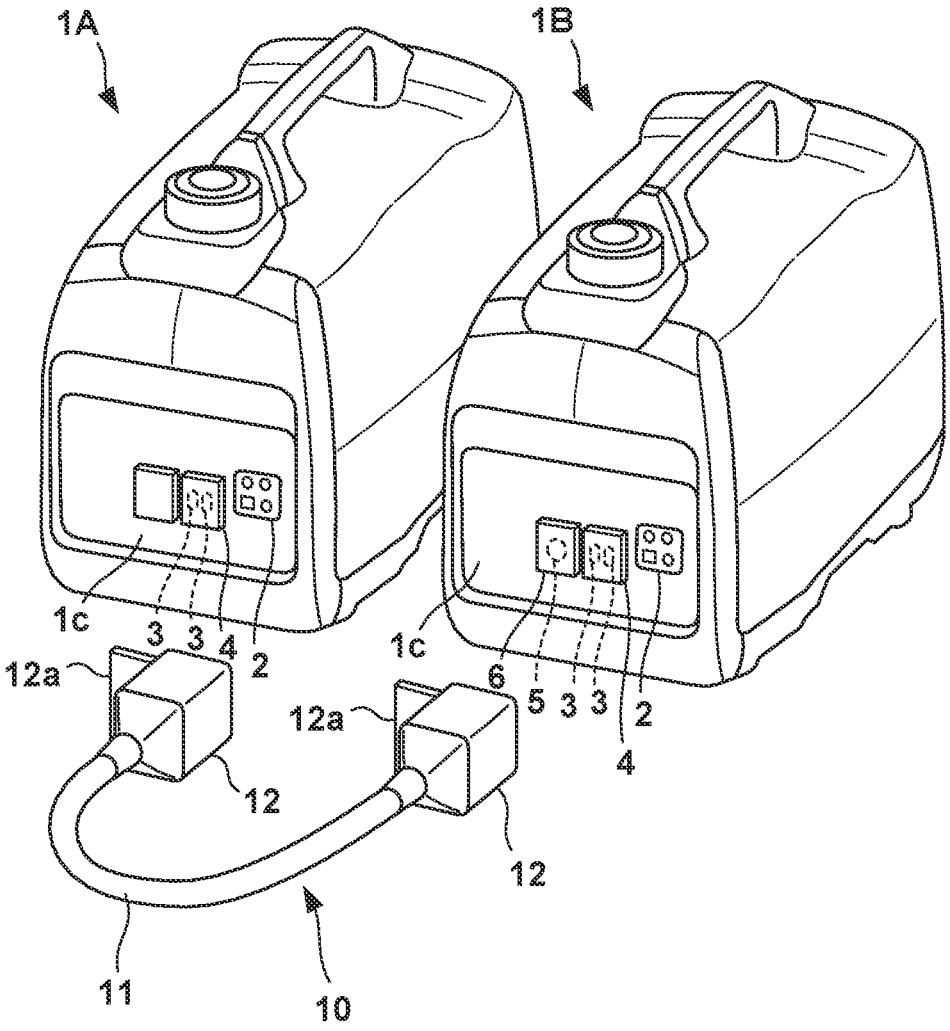
FIG. 1 is a perspective view showing the set of electric devices according to an embodiment of the present invention.
Figure 2:
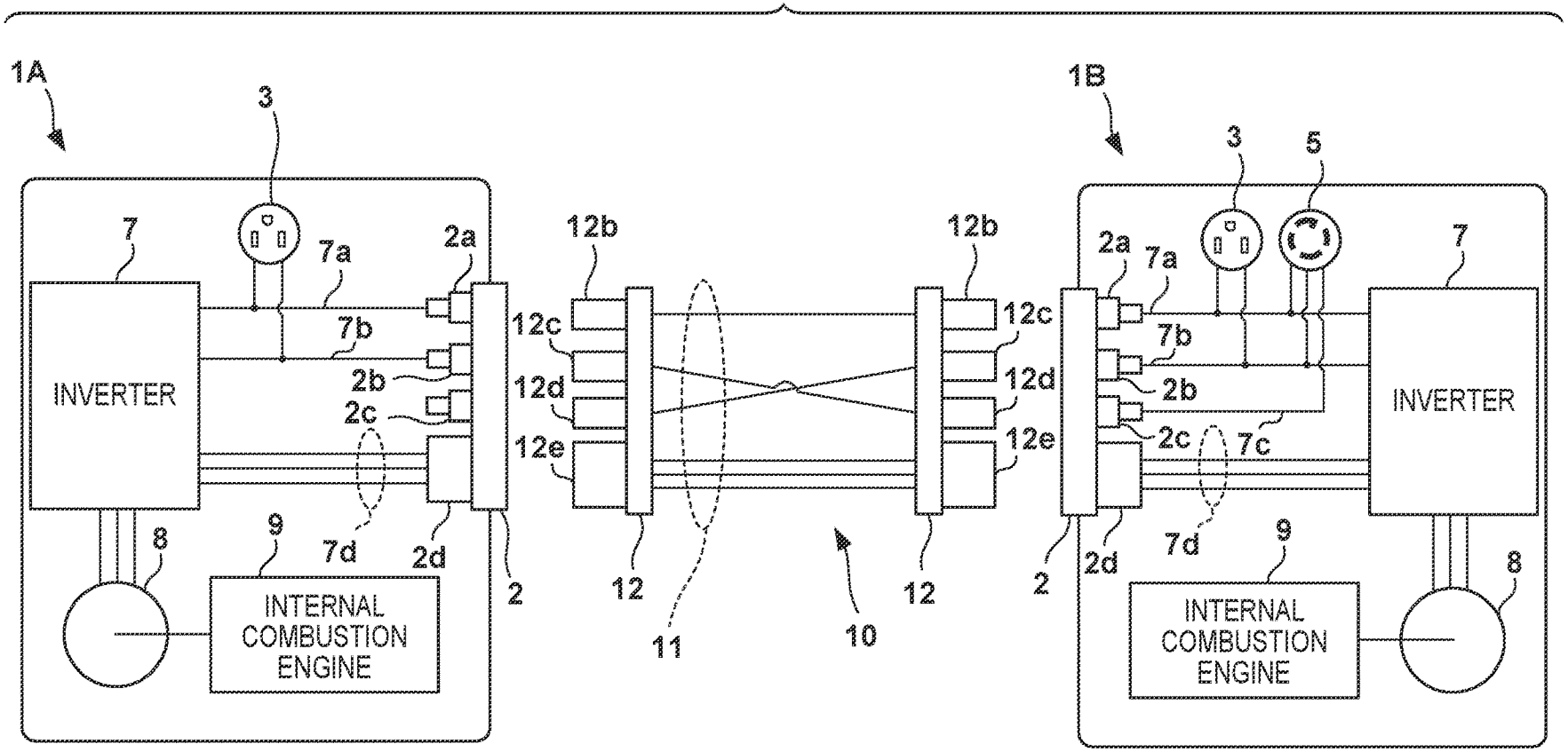
FIG. 2 is a view showing a connection relationship when the two electric devices shown in FIG. 1 are connected through a wiring cable.

FIG. 1 is a perspective view showing electric devices 1A and 1B and a wiring cable 10 for connecting the electric devices 1A and 1B in series with each other according to an embodiment of the present invention. FIG. 2 is a view showing a connection relationship when the two electric devices 1A and 1B are connected through the wiring cable 10.

The electric devices 1A and 1B according to this embodiment are portable AC power generators having common basic arrangements and having the same rated voltage, for example, single-phase 100 V, 120 V, or 125 V. Each of the electric devices 1A and 1B includes an inverter 7, a power generator 8, and an internal combustion engine 9. The internal combustion engine 9 is a reciprocating engine using gasoline as a fuel. The power generator 8 is connected to the output shaft (for example, a crank shaft) of the corresponding internal combustion engine 9 and converts the output from the corresponding internal combustion engine 9 into a power. In this embodiment, the power generator 8 is a multipole alternator for generating an AC power. The power generator 8 can be used as a starter motor of the corresponding internal combustion engine 9.

Each inverter 7 includes, for example, a rectifying smoothing circuit, an inverter circuit, and a control unit. The rectifying smoothing circuit rectifies and smoothes the 3-phase AC power output from the corresponding power generator 8. The inverter circuit converts the DC power output from the corresponding rectifying smoothing circuit into a single-phase AC power. Each inverter circuit includes a plurality of switching elements such as MOSFETs. Each control unit includes a CPU, a storage unit (for example, a ROM and a RAM), and an interface. The CPU executes programs stored in the storage unit and executes switching control of the corresponding inverter circuit and communication processing between the electric devices 1A and 1B.

Each of the electric devices 1A and 1B has, on a wall surface 1*c* which forms one end face of the outer shape, cable connection portions to which wiring cables can be connected. In this embodiment, two types of receptacles, that is, a receptacle 2 and receptacles 3 are arranged on the wall surface 1*c* of the electric device 1A, and three types of receptacles, that is, a receptacle 2, receptacles 3, and a receptacle 5 are arranged on the wall surface 1*c* of the electric device 1B. That is, the electric devices 1A and 1B are different from each other in that the electric device 1A does not have the receptacle 5.

The receptacle 2 is a connector for connecting the electric devices 1A and 1B in series with each other through the wiring cable 10. A plug 12 of the wiring cable 10 is connected to the receptacle 2. The receptacles 3 are connectors for outputting the individual rated voltages of the electric devices 1A and 1B. Electric loads which receive the powers from the electric devices 1A and 1B are connected to the above connectors. Examples of the electric loads are home appliances such as a cooker, an air conditioner, a television set, an illumination lights, and a dryer and industrial electric products such as an electric tool, a large illumination device, and a compressor.

In this embodiment, the receptacles 3 are arranged adjacent to the receptacle 2. More specifically, the two receptacles 3 are arranged for each electric device. A cover member 4 for opening/closing the two receptacles 3 is arranged on the wall surface 1*c*.

The receptacle 5 is arranged on only the electric device 1B and is a connector to which an electric load which receives the power from the electric device 1B is connected. The receptacle 5 is a locking connector having a function of locking a plug (not shown). A cover member 6 for opening/closing the receptacle 5 is arranged on the wall surface 1*c* of the electric device 1B. When the electric devices 1A and 1B are connected in series with each other through the wiring cable 10, the receptacle 5 can output an AC voltage double the rated voltage of each of the electric devices 1A and 1B. For example, if the rated voltage of each of the electric devices 1A and 1B is 125 V, an AC voltage of 250 V can be output from the receptacle 5. Its mechanism will be described with reference to FIG. 2.

A power line (potential line) 7*b* through which a generated current can flow, a neutral line 7*a*, and a plurality of control signal lines 7*d* are connected to the inverter 7 and are connected to a corresponding electrode 2*a*, a corresponding electrode 2*b*, and corresponding electrodes 2*d* of the receptacle 2, respectively. The plurality of control signal lines 7*d* includes signal lines for performing communication between the inverter 7 of the electric device 1A and the inverter 7 of the electric device 1B. The power line 7*b* and the neutral line 7*a* are connected to the corresponding electrodes of each of the receptacles 3. A single-phase two-wire electric load can be connected to each receptacle 3.

The wiring cable 10 includes a cable portion 11 obtained by bundling a plurality of wires and the plugs 12 arranged at two ends of the cable portion 11. Each plug 12 includes electrodes 12*b* to 12*d* and electrodes 12*e*. The electrodes 12*b* to 12*d* are connected to the electrodes 2*a* to 2*c* of the receptacle 2, respectively. The cable portion 11 connects the electrodes 12*b* so that the neutral line 7*a* of the electric device 1A is connected to the neutral line 7*a* of the electric device 1B through the wiring cable 10. The cable portion 11 connects the electrodes 12*e* so that the plurality of control signal lines 7*d* of the electric device 1A is connected to the plurality of control signal lines 7*d* of the electric device 1B through the wiring cable 10.

The cable portion 11 connects the electrodes 12*c* and 12*d*, and the wires for the electrodes 12*c* and 12*d* are crossed. No internal wire is connected to an electrode 2*c* of the receptacle 2 in the electric device 1A. On the other hand, in the electric device 1B, a power line 7*c* is connected to the electrode 2*c* of the receptacle 2. The power line 7*c*, the power line 7*b*, and the neutral line 7*a* are also connected to the corresponding electrodes arranged in the receptacle 5. The power line 7*b* of the electric device 1A is connected to the power line 7*c* of the electric device 1B through the wiring cable 10. The receptacle 5 forms a single-phase three-wire receptacle.

When the electric devices 1A and 1B are connected in series with each other through the wiring cable 10, the inverter 7 of the electric device 1A and the inverter 7 of the electric device 1B communicate with each other through the corresponding communication units. The inverter circuit control is performed such that the phases of the AC voltage waveforms output from the respective inverters 7 are shifted by 180°. Accordingly, an AC voltage double the rated voltage of each of the electric devices 1A and 1B can be output.

<Use Mode>

If the electric devices 1A and 1B are connected in series with each other through the wiring cable 10, it is assumed that an electric load is connected to the receptacle 5 and used. A state in which a single-phase three-wire system in a home or the like is connected to the receptacle 5, and the electric load is connected to each of the receptacles 3 is not preferable if ground faulting of the electric load connected to the receptacle 3 is considered. This embodiment has a structure to restrict the simultaneous use of the receptacles 3 and the receptacle 5.

<Restriction Structure of Simultaneous Use>

Figure 3:
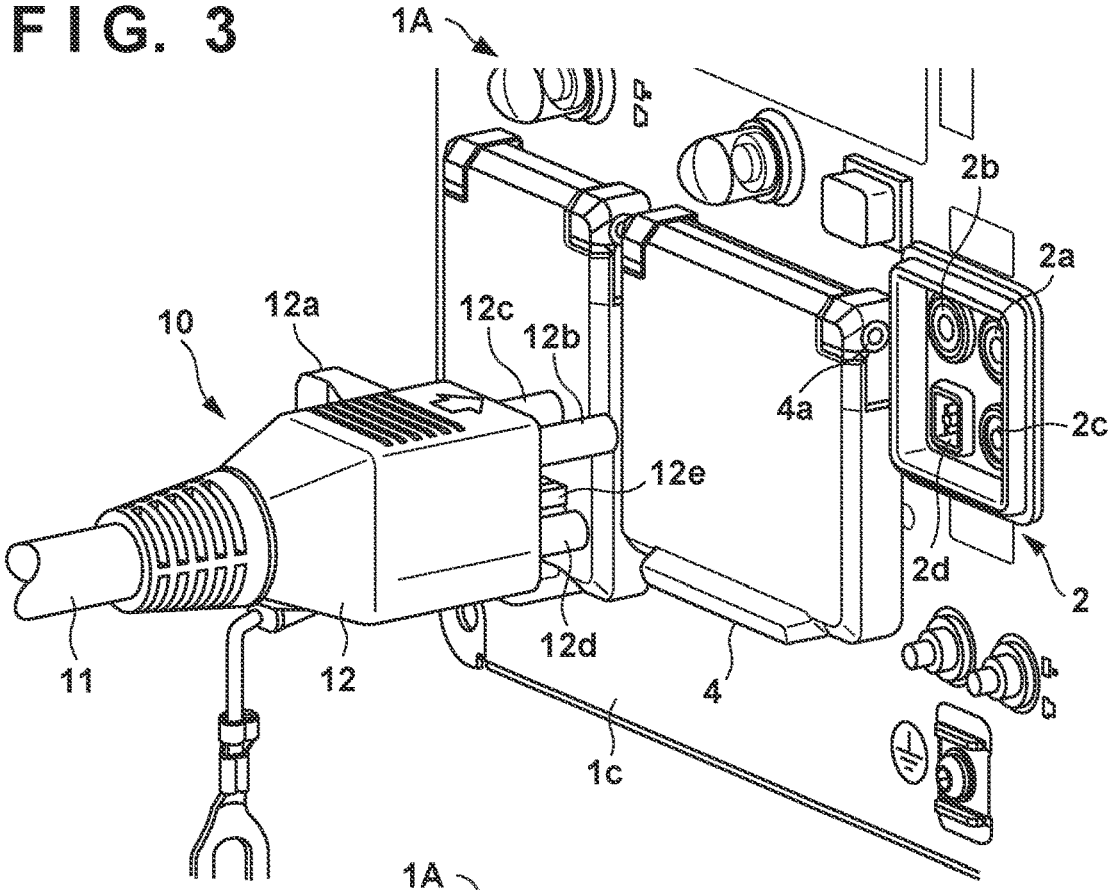
FIG. 3 is a perspective view of the cable connection portion of one electric device shown in FIG. 1.
Figure 4:
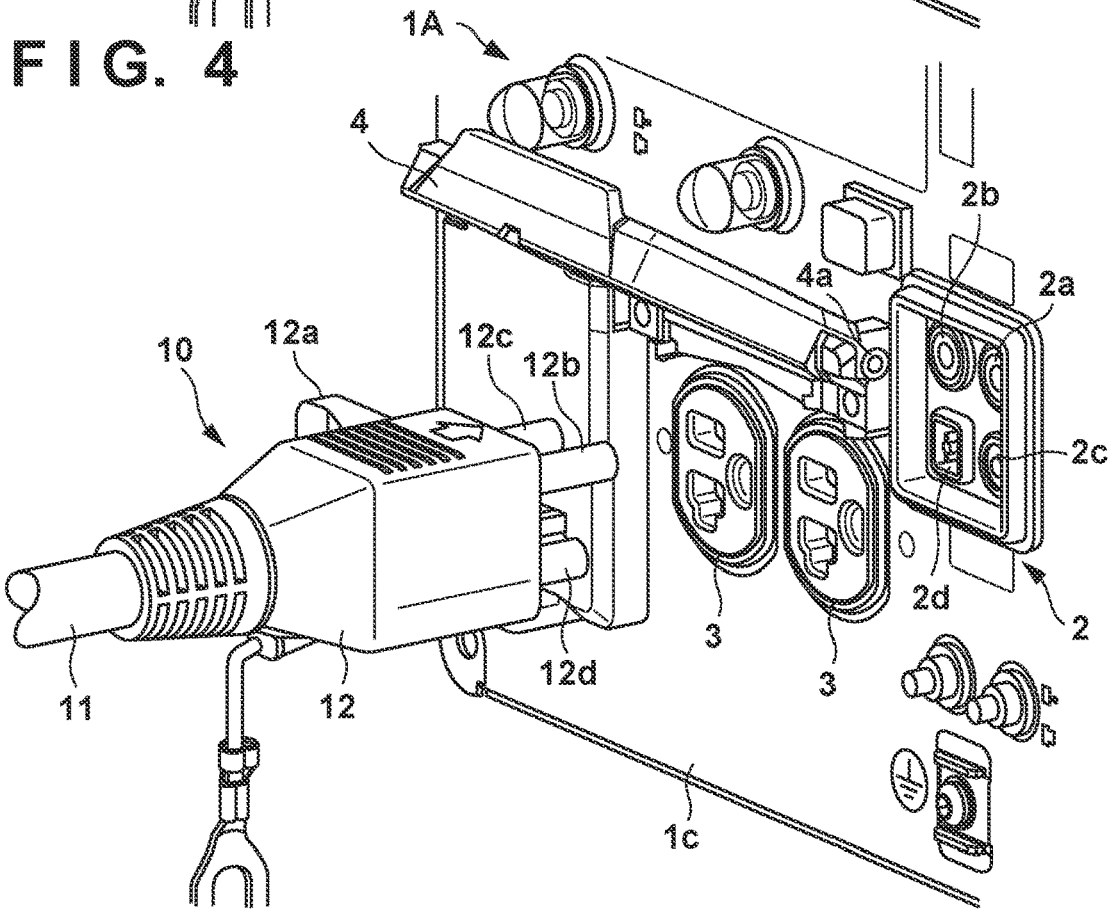
FIG. 4 is a perspective view of the cable connection portion of one electric device shown in FIG. 1.

FIGS. 3 and 4 are perspective views each showing the cable connection portion of the electric device 1A. FIG. 3 shows a state in which the cover member 4 is closed, while FIG. 4 shows a state in which the cover member 4 is open. The cover member 4 has a rectangular box-like shape whose back surface is open. The cover member 4 is pivotally supported on the wall surface 1*c* through a pivotal shaft 4*a* at the upper side portion of the cover member 4. The pivotal shaft 4*a* is a shaft extending in a direction along the wall surface 1*c*. In this embodiment, the pivotal shaft 4*a* extends in the horizontal direction. The cover member 4 pivots in the vertical direction about the pivotal shaft 4*a* such that the free end (lower end) of the cover member 4 comes close to or is spaced apart from the wall surface 1*c*. Note that the pivotal shaft 4*a* may extend in the vertical direction. Alternatively, the pivotal shaft 4*a* may extend in a normal direction to the wall surface 1*c* and the cover member 4 may pivot along the wall surface 1*c*.

A projecting portion 12*a* projecting toward the cover member 4 is arranged on the side portion of the plug 12 on the side of the cover member 4. In other words, the projecting portion 12*a* projects in a direction crossing the connecting direction (the normal direction of the wall surface 1*c*) of the plug 12 with respect to the receptacle 2. In this embodiment, the projecting portion 12*a* is a plate-like member and is formed integrally with the plug 12.

The projecting portion 12*a* is arranged at a position on the pivotal locus of the cover member 4 in a state in which the plug 12 is connected to the receptacle 2. Accordingly, the connection of the plug 12 to the receptacle 2 and the connection of the electric load to each receptacle 3 can be exclusively performed.

Figure 5A:
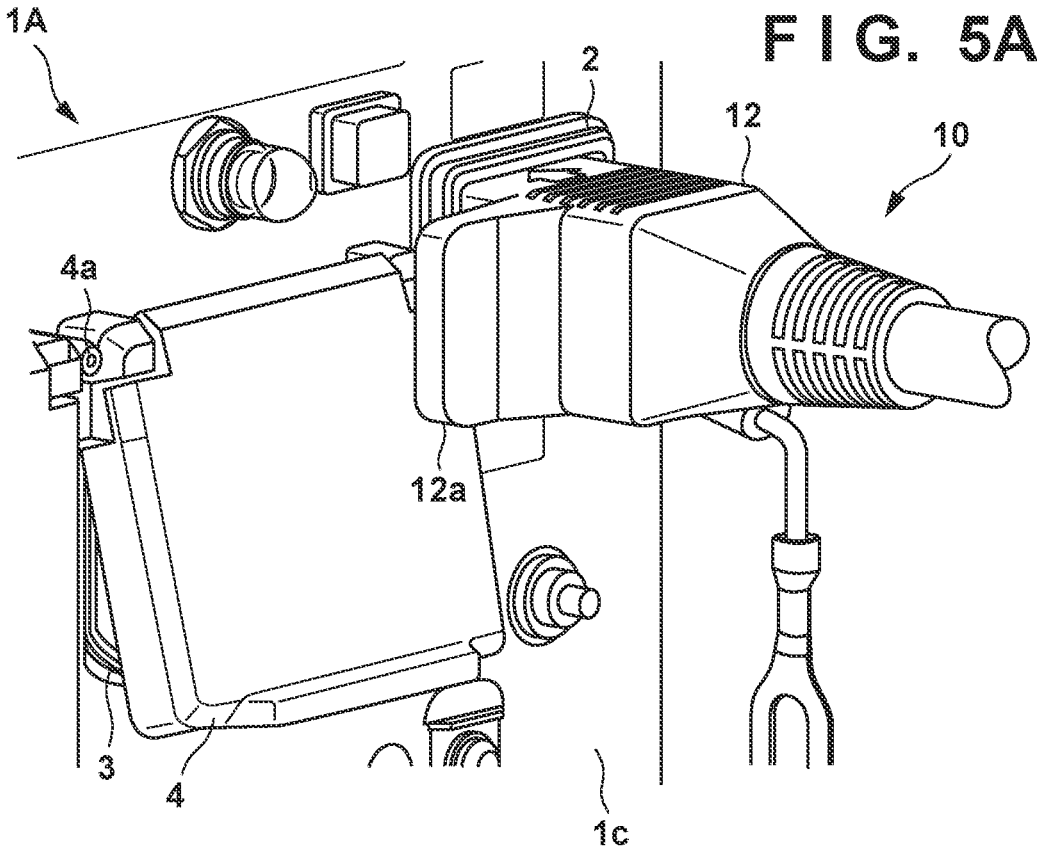
FIGS. 5A and 5B are views showing the restriction mode of simultaneous use of receptacles.
Figure 5B:
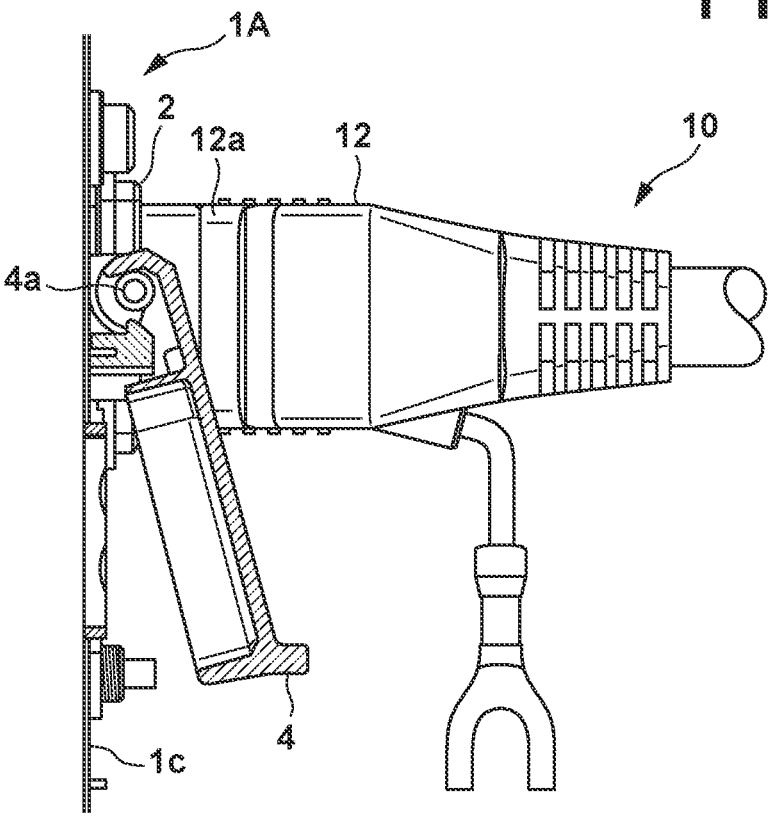

FIGS. 5A and 5B show the state in which the plug 12 is connected to the receptacle 2. The projecting portion 12*a* overlaps the cover member 4 when viewed in the normal direction of the wall surface 1*c*. For this reason, when the user tires to open the cover member 4, as shown in FIG. 4, the right portion of the cover member 4 interferes with the projecting portion 12*a*, and the cover member 4 cannot be opened to an extent that each receptacle 3 is perfectly exposed, as shown in FIGS. 5A and 5B. That is, connection of the electric load plug to each receptacle 3 is impossible.

Figure 6A:
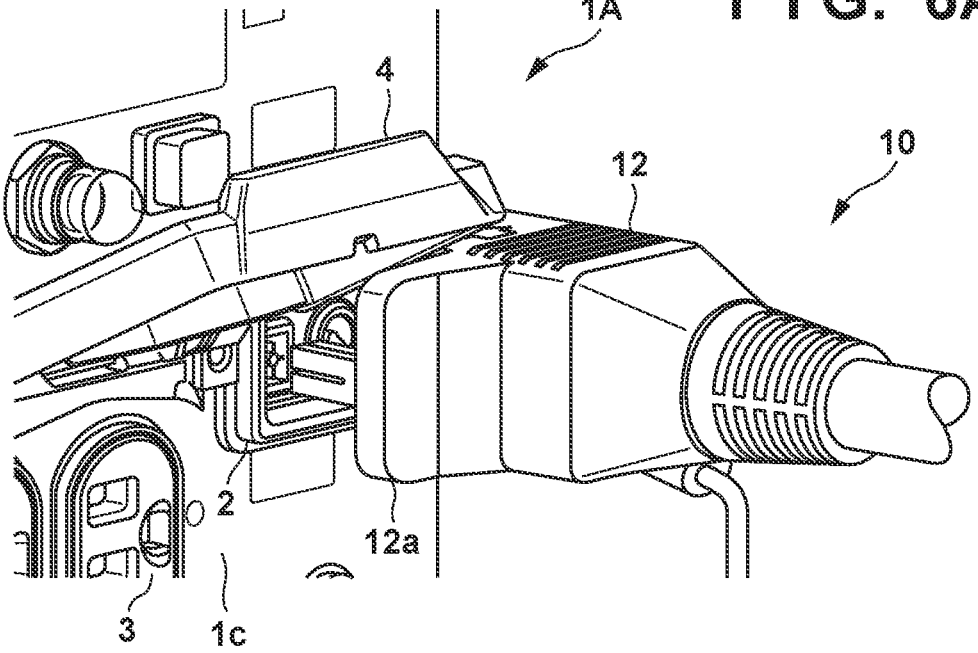
FIGS. 6A and 6B are views showing the restriction mode of simultaneous use of the receptacles.
Figure 6B:
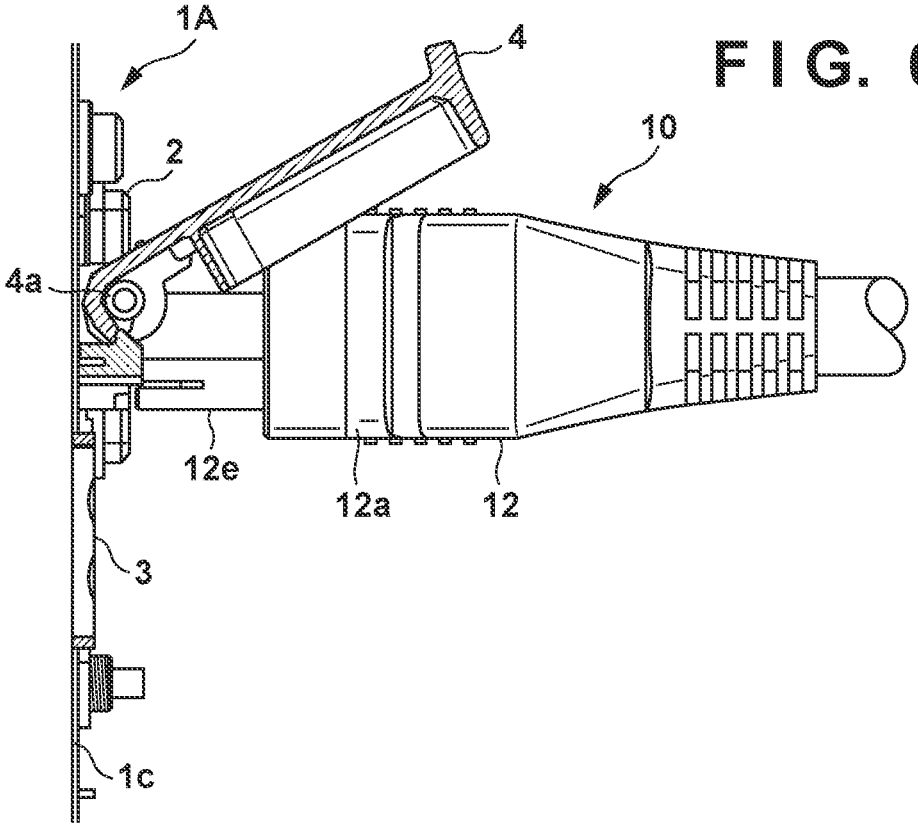

FIGS. 6A and 6B shows a state in which the plug 12 is tried to be connected to the receptacle 2 in a state in which the cover member 4 is open. If the user tries to connect the plug 12 to the receptacle 2, the right portion of the cover member 4 interferes with the projecting portion 12*a*, and the plug 12 cannot be further pushed into the receptacle 2. That is, the connection of the plug 12 of the wiring cable 10 to the receptacle 2 is impossible.

Figure 7A:
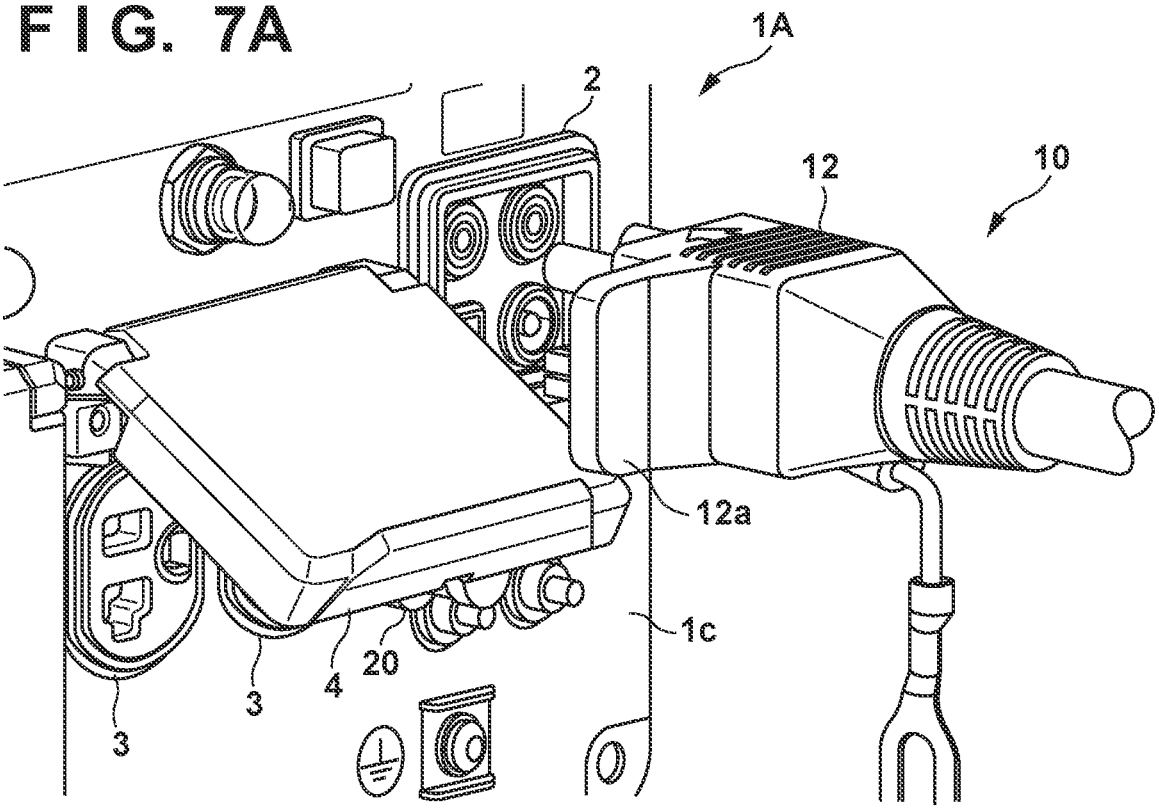
FIGS. 7A and 7B are views showing the restriction mode of simultaneous use of the receptacles.
Figure 7B:
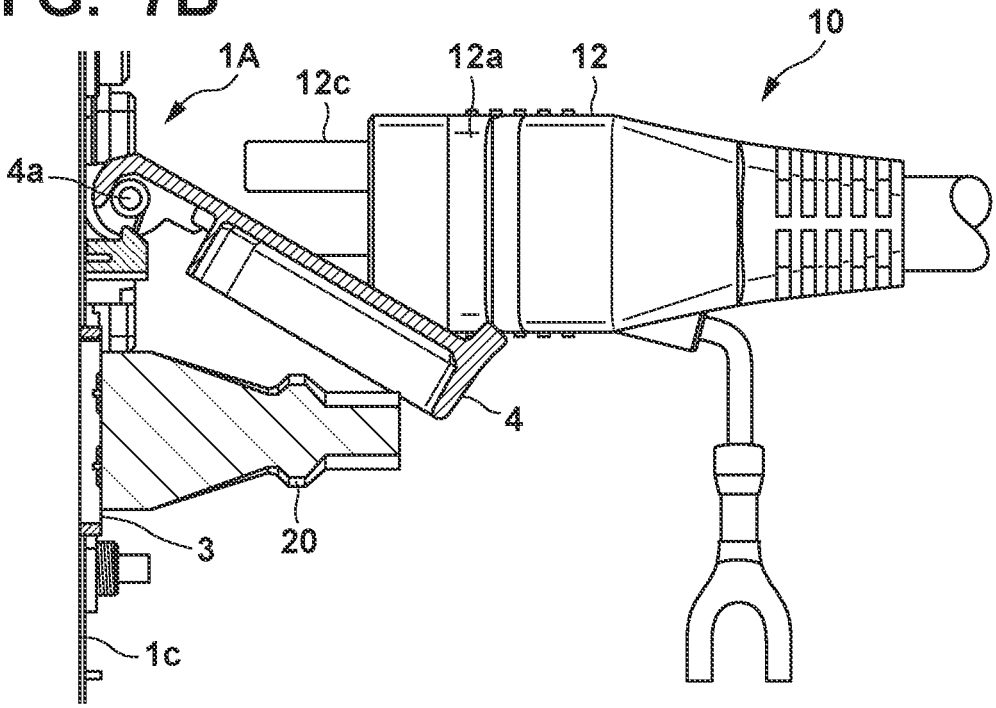

FIGS. 7A and 7B show a state in which an electric load plug 20 is connected to the corresponding receptacle 3. The cover member 4 is half open due to the presence of the plug 20. If the user tries to connect the plug 12 to the receptacle 2, the right portion of the cover member 4 interferes with the projecting portion 12*a*, and the cover member 4 cannot be further closed due to the interference with the plug 20, and the plug 12 cannot be further pushed into the receptacle 2. That is, the connection of the plug 12 of the wiring cable 10 to the receptacle 2 is impossible.

As described above, in order to connect the plug 12 to the receptacle 2, the cover member 4 must be kept closed, and the plug 20 cannot be connected to the corresponding receptacle 3. In order to connect the plug 20 to the corresponding receptacle 3, the cover member 4 must be opened. In order to open the cover member 4, it is necessary not to connect the plug 12 to the receptacle 2. In addition, when the plug 20 is connected to the corresponding receptacle 3, the plug 12 cannot be connected to the receptacle 2.

As a result, when the electric load is connected to the corresponding receptacle 3, the electric device 1A and the electric device 1B cannot be connected in series with each other through the wiring cable 10. Accordingly, each receptacle 3 of the electric device 1A and the receptacle 5 of the electric device 1B cannot be simultaneously used. As described above, according to this embodiment, simultaneous connections of the plugs 12 and 20 to the receptacles 2 and 3 can be restricted physically and mechanically using the interference between the projecting portion 12*a* and the cover member 4. Therefore, simultaneous use of each receptacle 3 of the electric device 1A and the receptacle 5 of the electric device 1B can be restricted.

Note that the electric device 1B also includes the restriction structure by the interference between the projecting portion 12*a* and the cover 4, so that the simultaneous connections of the plugs 12 and 20 to the receptacles 2 and 3 of the electric device 1B are also restricted.

Second Embodiment

Figure 8A:
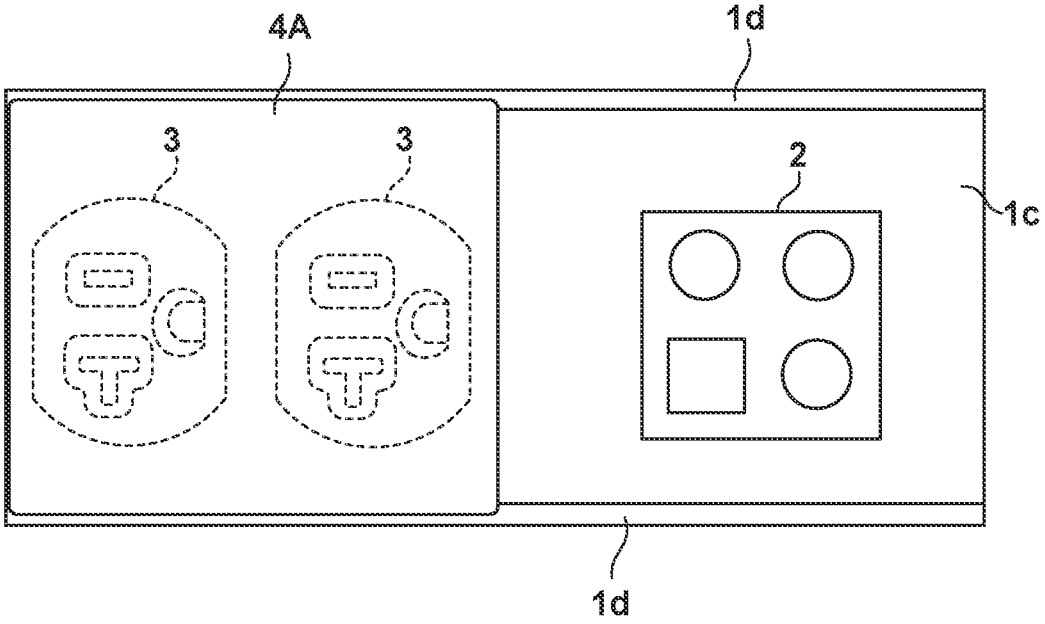
FIGS. 8A and 8B are views for explaining another embodiment.
Figure 8B:
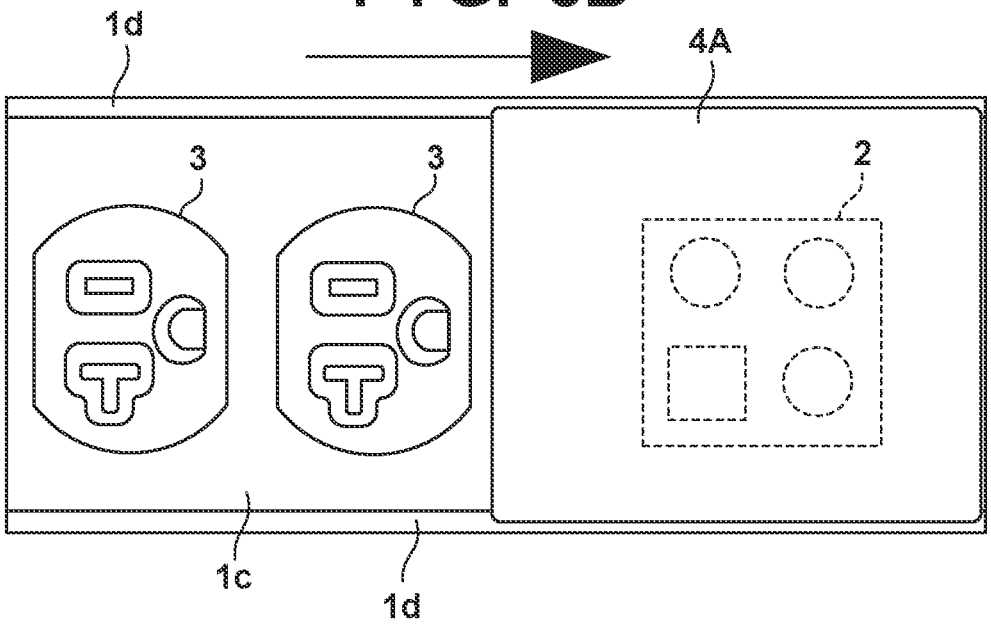

Examples of another restriction structure in simultaneous use of receptacles 3 and a receptacle 5 will be described below. FIGS. 8A and 8B show an example in which a cover member 4A for selectively covering a receptacle 2 and the receptacles 3 is arranged. This restriction structure may be arranged in one or both of an electric device 1A and an electric device 1B.

The cover member 4A is a substitute member of the cover member 4 of the first embodiment. The cover member 4A is slidable in the right and left directions by being guided by a pair of rail members 1*d* arranged on a wall surface 1*c*.

FIG. 8A shows a state in which the cover member 4A is located at the position where the receptacles 3 are covered. In this state, the cover member 4A does not cover the receptacle 2. Accordingly, a plug 12 can be connected to the receptacle 2. Even if the user tries to connect an electric load plug 20 to one of the receptacles 3, the plug 20 interferes with the cover member 4A and cannot be connected to the corresponding receptacle 3.

FIG. 8B shows a state in which the cover member 4A is slid toward the receptacle 2 from the state shown in FIG. 8A and is located at the position where the receptacle 2 is covered. In this state, the cover member 4A does not cover the receptacles 3. Accordingly, the electric load plug 20 can be connected to one of the receptacles 3. However, if the user tries to connect the plug 12 to the receptacle 2, the plug 12 interferes with the cover member 4A and cannot be connected to the receptacle 2.

In the state of FIG. 8A in which the receptacle 2 is connected to the plug 12, if the user tries to slide the cover member 4A to the position of FIG. 8B, the cover member 4A interferes with the plug 12 and cannot be slid. That is, the plug 20 cannot be connected to the corresponding receptacle 3. To the contrary, in a state of FIG. 8B in which the plug 20 is connected to the corresponding receptacle 3, if the user tries to slide the cover member 4A to the position of FIG. 8A, the cover member 4A and the plug 20 interfere with each other, and the cover member 4A cannot be slid. That is, it is impossible to connect the plug 12 to the receptacle 2.

As described above, according to this embodiment, there is provided a structure in which the receptacle 2 and the receptacles 3 are exclusively opened/closed by the cover member 4A. For this reason, when the electric load is connected to the corresponding receptacle 3, the electric device 1A and the electric device 1B cannot be connected in series with each other through the wiring cable 10. Therefore, the receptacles 3 of the electric device 1A or 1B cannot be used simultaneously with the receptacle 5 of the electric device 1B.

Figure 9A:
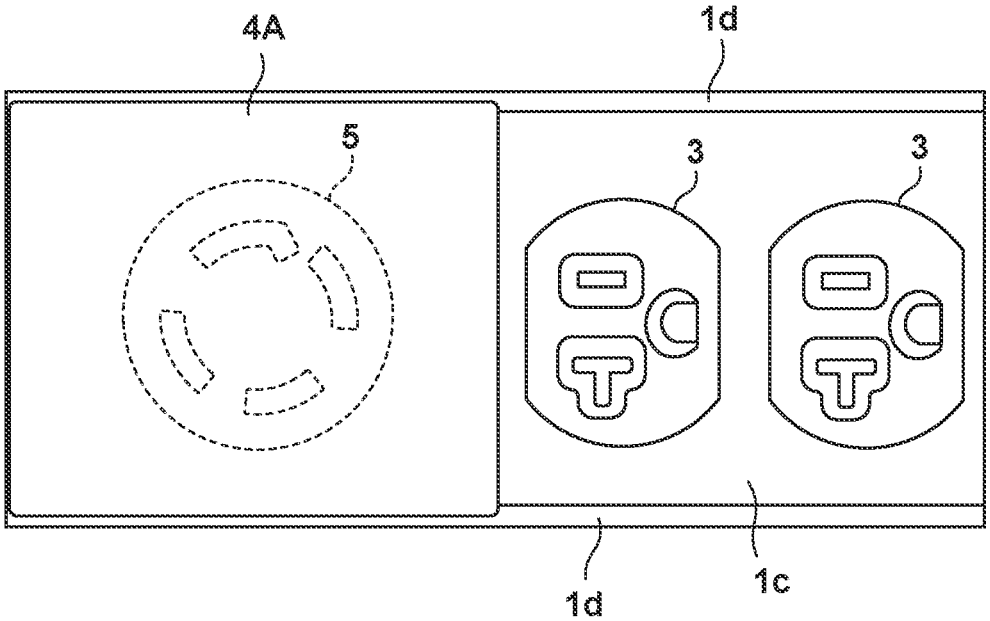
FIGS. 9A and 9B are views for explaining the embodiment shown in FIGS. 8A and 8B.
Figure 9B:
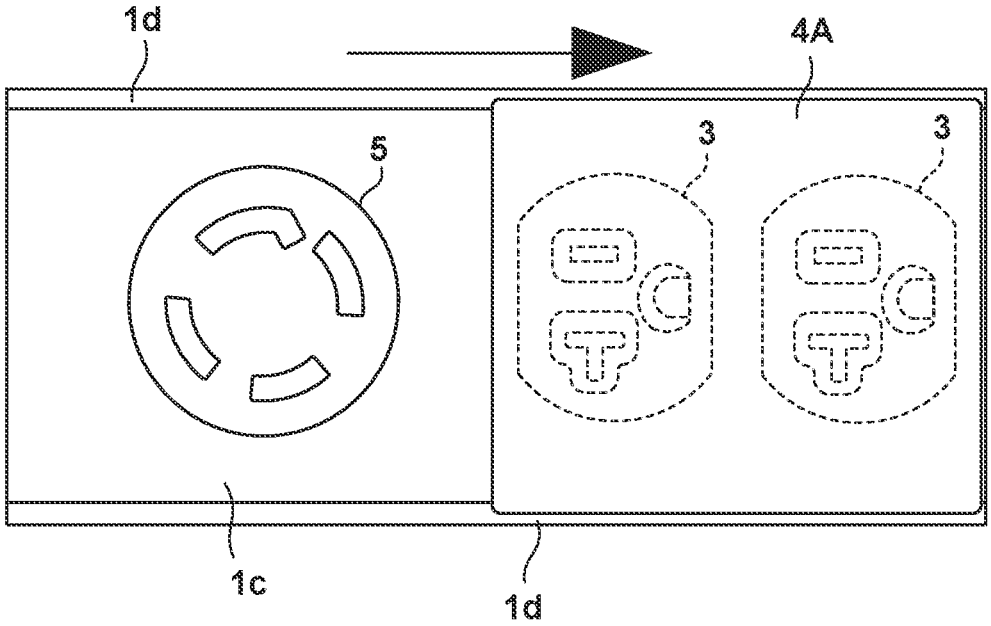

FIGS. 9A and 9B show an example in which the opening/closing structure of the cover member 4A is applied to the receptacles 3 and the receptacle 5 of the electric device 1B.

FIG. 9A shows a state in which the cover member 4A is located at the position where the receptacle 5 is covered. In this state, the cover member 4A does not cover the receptacles 3. The electric load plug 20 can be connected to each of the receptacles 3. If the user tries to connect an electric load plug (not shown) to the receptacle 5, this plug interferes with the cover member 4A and cannot be connected to the receptacle 5. Even if the electric device 1A and the electric device 1B are connected in series with each other through the wiring cable 10, the receptacles 3 and the receptacle 5 cannot be simultaneously used.

FIG. 9B shows a state in which the cover member 4A is slid toward the receptacles 3 from the state of FIG. 9A, and the cover member 4A is located at the position where the receptacles 3 are covered. In this state, the cover member 4A does not cover the receptacle 5. The electric load plug can be connected to the receptacle 5. However, if the user tries to connect the plug to each of the receptacles 3, the plug interferes with the cover member 4 and cannot be connected to the corresponding receptacle 3.

In a state of FIG. 9A in which the plug 20 is connected to the corresponding receptacle 3, if the user tries to slide the cover member 4A to the position of FIG. 9B, the cover member 4A and the plug 20 interfere with each other, and the cover member 4A cannot be slid. That is, the electric load plug cannot be connected to the receptacle 5. To the contrary, in a state of FIG. 9B in which the plug is connected to the receptacle 5, if the user tries to slide the cover member 4A to the position of FIG. 9A, the cover member 4A and the plug interfere with each other, and the cover member 4A cannot be slid. That is, the plug 20 cannot be connected to the corresponding receptacle 3.

As described above, according to this embodiment, there is provided a structure in which the receptacles 3 and the receptacle 5 are exclusively opened/closed by the cover member 4A. Therefore, the receptacles 3 and the receptacle 5 of the electric device 1B cannot be simultaneously used.

Note that in this embodiment, although the cover member 4A is slid, another displacement mode may be employed. For example, the cover member 4A may be pivoted along the wall surface 1*c* to be displaceable between the position where the receptacles 3 are covered and the position where the receptacle 5 is covered.

Third Embodiment

Figure 10:
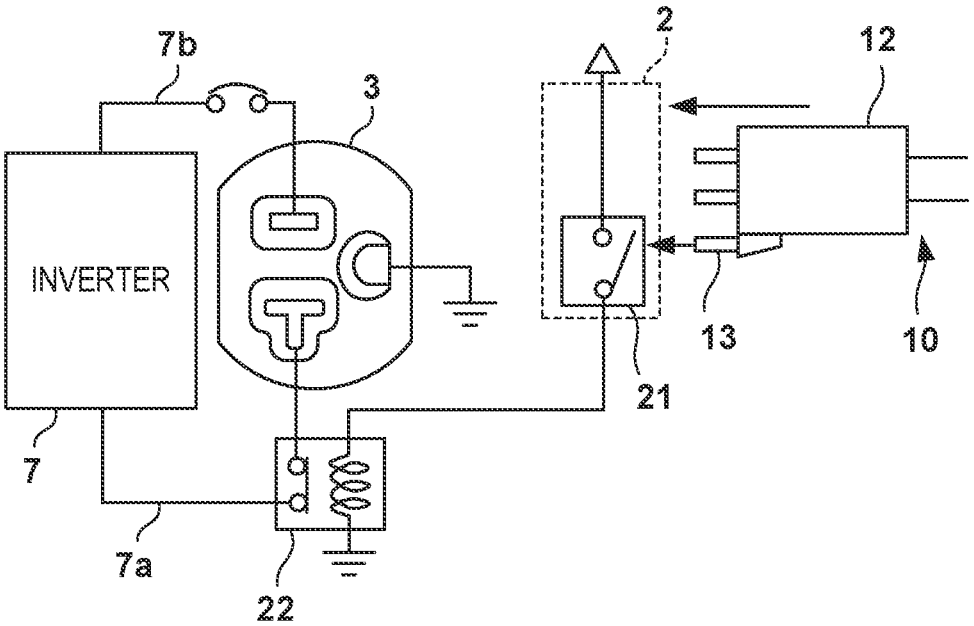
FIG. 10 is a view for explaining still another embodiment.

An example of another restriction structure of simultaneous use of a receptacle 3 and a receptacle 5 will be described below. The first and second embodiments employ the physical and mechanical restriction, but the third embodiment employs a restriction using an electric circuit. FIG. 10 is a diagram showing an example of an electric circuit. This circuit may be arranged in one or both of an electric device 1A and an electric device 1B. This electric circuit can be used together with the first and second embodiments.

In the third embodiment, an inverter 7 serving as an internal circuit for supplying a power to the receptacle 3 and a connection/disconnection circuit 22 arranged between the inverter 7 and the receptacle 3 are arranged. The connection/disconnection circuit 22 performs connection/disconnection of a neutral line 7*a* and the corresponding electrode of the receptacle 3. In this embodiment, the connection/disconnection circuit 22 is formed from a relay, but may be another switching element such as a transistor. The contact of the connection/disconnection circuit 22 is kept off in the normal mode, and the connection/disconnection circuit 22 is set in a state in which the neutral line 7*a* and the corresponding electrode of the receptacle 3 are connected.

A mechanical switch 21 such as a pushbutton switch is arranged in the receptacle 2. The switch 21 is normally set in the OFF state. An operation portion 13 extending from the plug 12 is arranged on a plug 12 of a wiring cable 10. When the plug 12 is connected to the receptacle 2, the operation portion 13 pushes the contact of the switch 21 to set the switch 21 in the ON state.

When the mechanical switch 21 is set in the ON state, the coil of the connection/disconnection circuit (relay) 22 is energized to open the contact of the relay 22. The neutral line 7*a* is disconnected from the corresponding electrode of the receptacle 3, that is, a state in which the receptacle 3 is disconnected from the inverter 7 is set, and no power is supplied.

With the above arrangement, when the plug 12 of the wiring cable 10 is connected to a receptacle 2, the receptacle 3 cannot be used. Accordingly, simultaneous use of the receptacle 3 of the electric device 1A or 1B and the receptacle 5 of the electric device 1B is restricted.

Figure 11:
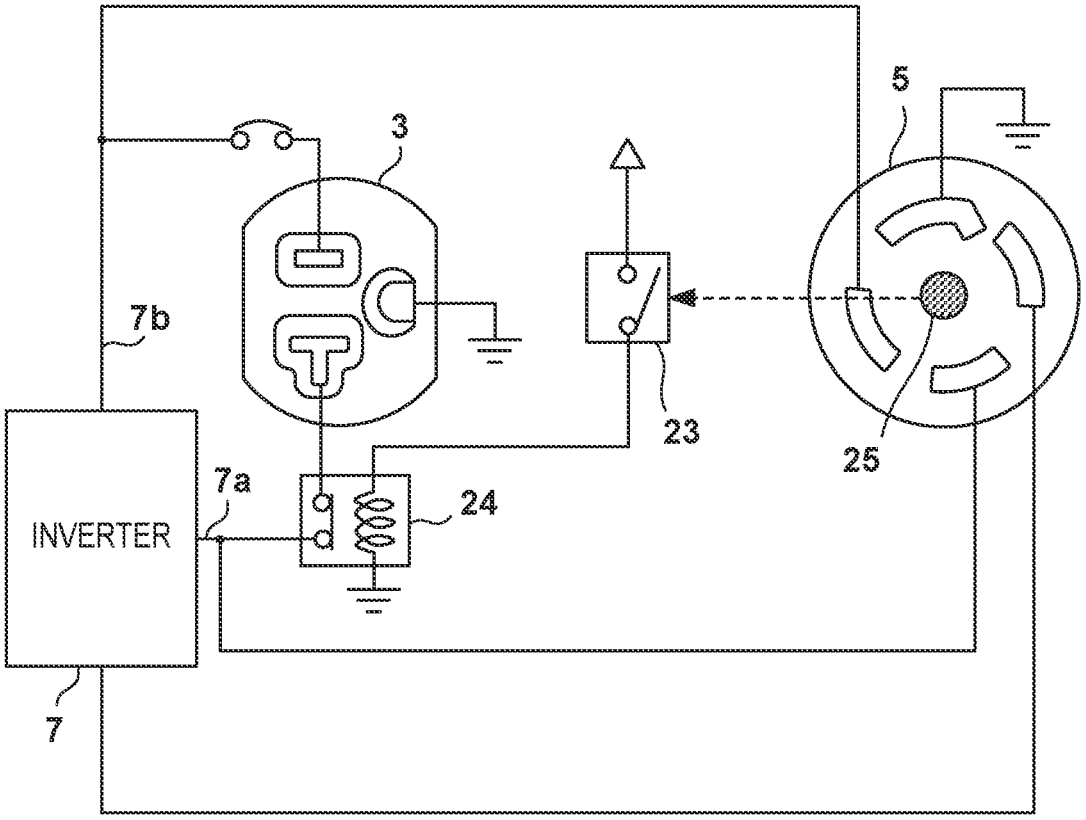
FIG. 11 is a view for explaining the embodiment shown in FIG. 10.

FIG. 11 shows an example in which a circuit similar to that of FIG. 10 is applied to the receptacle 3 and the receptacle 5 of the electric device 1B. Similarly, in an example of FIG. 11, the inverter 7 serving as the internal circuit for supplying a power to the receptacle 3 and a connection/disconnection circuit 24 arranged between the inverter 7 and the receptacle 3 are arranged. The connection/disconnection circuit 24 performs connection/disconnection of the neutral line 7*a* and the corresponding electrode of the receptacle 3. In this embodiment, the connection/disconnection circuit 24 is formed from a relay, but may be another switching element such as a transistor. The contact of the connection/disconnection circuit 24 is kept off in the normal mode, and the connection/disconnection circuit 24 is set in a state in which the neutral line 7*a* and the corresponding electrode of the receptacle 3 are connected.

A mechanical switch 23 such as a pushbutton switch is arranged in the receptacle 5. A button portion 25 of the switch 23 extends from the surface of the receptacle 5. The switch 23 is normally set in the OFF state. When the electric load plug is connected to the receptacle 5, the button portion 25 pushes the plug to set the switch 23 in the ON state.

When the switch 23 is set in the ON state, the coil of the connection disconnection circuit (relay) 24 is energized to open the contact of the relay 24. The neutral line 7*a* is disconnected from the corresponding electrode of the receptacle 3, that is, a state in which the receptacle 3 is disconnected from the inverter 7, and no power is supplied is set.

With the above arrangement, when the plug is connected to the receptacle 5, the receptacle 3 cannot be used. Accordingly, simultaneous use of the receptacle 3 and the receptacle 5 of the electric device 1B is restricted.

Note that in this embodiment, the connection of the plug 12 to the receptacle 2 or the connection of the plug to the receptacle 5 is detected by the mechanical switch 21 or 23. However, the connection detection method is not limited to this. For example, a current flowing upon connection may be detected by a current sensor to detect the connection. More specifically, when detecting the connection of the plug 12 to the receptacle 2, a current sensor for monitoring a current flowing through a power line 7*c* is arranged. The current sensor is formed from, for example, a switching element such as a transistor which is turned on when a current having a value equal to or larger than a predetermined value flows. When the current sensor detects a current having a value equal to or larger than the predetermined value, the relay of the connection/disconnection circuit 22 of the electric device 1B is energized to set the connection/disconnection circuit 22 in the OFF state. A similar arrangement may be employed even if the connection of the plug to the receptacle 5 is to be detected.

In the above arrangement, the connection/disconnection circuit 22 or 24 disconnects the receptacle 3 from the inverter 7. However, the connection of the plug 20 to the receptacle 3 may be detected to disconnect the receptacle 5 and the inverter 7 from each other.

Fourth Embodiment

In order to cope with the cover member 4 of the first embodiment or the cover member 4A of the second embodiment coming off, a sensor for detecting the state of each of the covers 4 and 4A is arranged, and power supply at the time of DC connection of electric devices 1A and 1B may be inhibited by the control of an inverter 7.

Figure 12A:
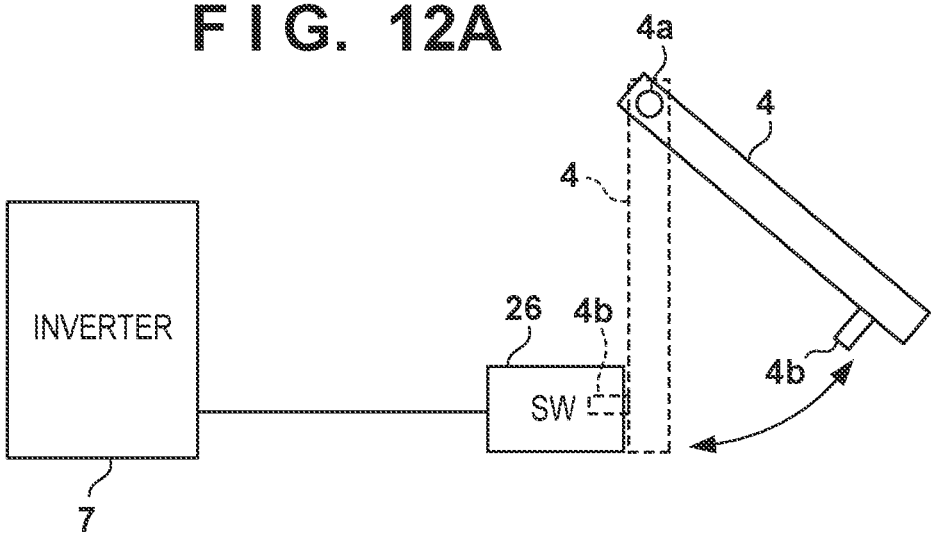
FIGS. 12A and 12B are views for explaining still another embodiment.

FIG. 12A shows an example in which a sensor 26 for detecting that the cover member 4 is set in the closed state is arranged in the first embodiment. The sensor 26 is a mechanical switch arranged on a wall surface 1*c*. An operation portion 4*b* is arranged at the end portion of the cover member 4. When the cover member 4 is closed, the operation portion 4*b* pushes the sensor 26 to turn on the sensor 26. When the cover member 4 is not closed, the sensor 26 is set in the OFF state.

A detection signal from the sensor 26 is transmitted to the inverter 7. If the sensor 26 is not set in the ON state, the control unit of the inverter 7 does not perform power supply control at the time of the DC connection of the electric devices 1A and 1B. For this reason, assume that the cover member 4 has come off, that the electric devices 1A and 1B are connected in series with each other through a wiring cable 10, and that an electric load plug 20 can be connected to a receptacle 3. Even in this case, the inverter 7 can control to restrict the output of the AC power from a receptacle 5. Therefore, the simultaneous use of the receptacle 3 and the receptacle 5 can be restricted.

Figure 12B:
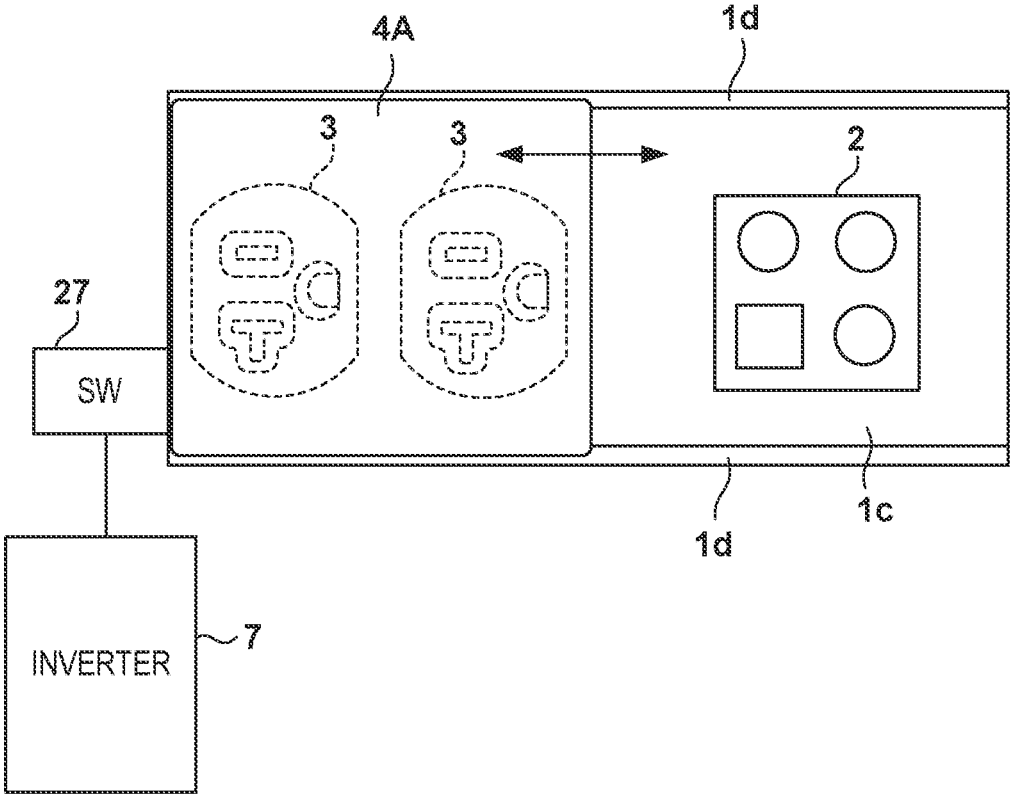

FIG. 12B shows an example in which a sensor 27 for detecting that the cover member 4A is located at the position where the receptacles 3 are covered is arranged in the second embodiment (FIGS. 8A and 8B). The sensor 27 is a mechanical switch arranged on the wall surface 1*c*. When the cover member 4A is located at the position where the receptacles 3 are covered, the side portion of the cover member 4A pushes the sensor 27 to turn on the sensor 27. When the cover member 4A is located at the position where the receptacles 3 are covered, the sensor 27 is set in the OFF state.

A detection signal from the sensor 27 is transmitted to the inverter 7. If the sensor 27 is not set in the ON state, the control unit of the inverter 7 does not perform power supply control at the time of the DC connection of the electric devices 1A and 1B. For this reason, even if hypothetically the cover member 4A came off, the electric devices 1A and 1B were connected in series with each other through the wiring cable 10, and the electric load plug 20 were connectable to the corresponding receptacle 3, the inverter 7 could control to restrict the output of the AC power from the receptacle 5. Therefore, the simultaneous use of the receptacle 3 and the receptacle 5 can be restricted. An arrangement similar to that described above can be employed for the second embodiment shown in FIGS. 9A and 9B.

Note that each of the sensors 26 and 27 may be formed from a photointerrupter or the like in place of the mechanical switch.

Other Embodiments

The above embodiments have exemplified power generators as the electric devices 1A and 1B. However, if an electric device has a plurality of receptacles and is used to inhibit simultaneous use of the receptacles, the present invention is also applicable to an electric device other than the power generator.

Summary of Embodiments

The above embodiments disclose at least the following electric devices or wiring cable.

1. An electric device (for example, 1A, 1B) of each of the above embodiments comprises:

a first receptacle (for example, 2, 5) to which a first plug is connected;

a second receptacle (for example, 3) to which a second plug (for example, 20) is connected; and a cover member (for example, 4, 4A) configured to open/close the second receptacle, wherein in a state in which the first plug is connected to the first receptacle, opening of the cover member is restricted by interference between the first plug and the cover member, and in a state in which the second plug is connected to the second receptacle, connection of the first plug to the first receptacle is restricted by interference between the first plug and the cover member.

According to this embodiment, there is provided a technique for restricting simultaneous use of two receptacles.

2. In the electric device of each of the above embodiments, the first plug (for example, 12) includes a projecting portion (for example, 12*a*) projecting in a direction crossing a connection direction of the first plug with respect to the first receptacle, the cover member (for example, 4) is pivotally supported around a pivotal shaft (for example, 4*a*) in a direction along a wall surface (for example, 1*c*) on which the second receptacle is arranged, and the projecting portion is located on a pivotal locus of the cover member in a state in which the first plug is connected to the first receptacle.

According to this embodiment, the pivotal motion of the cover member is restricted by the projecting portion, and insertion/removal of the first plug can be restricted by the pivotal position of the cover member.

3. In the electric device of each of the above embodiments, the cover member (for example, 4A) is supported to be displaceable between a position where the cover member covers the second receptacle but does not cover the first receptacle and a position where the cover member covers the first receptacle but does not cover the second receptacle.

According to this embodiment, the first receptacle and the second receptacle can be exclusively used physically and mechanically. The simultaneous use of these two receptacles can be restricted.

4. In the electric device of each of the above embodiments, the cover member is supported to be slidable in a direction along the wall surface (for example, 1*c*) on which the first receptacle and the second receptacle are arranged.

According to this embodiment, the cover member can be displaced with a relatively simple arrangement, and the cover member can be displaced relatively easily by a user operation.

5. An electric device (for example, 1A, 1B) of each of the above embodiments comprises:

a first receptacle (for example, 2, 5) to which a first plug is connected;

a second receptacle (for example, 3) to which a second plug is connected;

an internal circuit (for example, 7) configured to supply a power to the second receptacle; and a connection/disconnection circuit (for example, 22, 24) configured to connect/disconnect the second receptacle and the internal circuit, wherein the connection/disconnection circuit disconnects the second receptacle and the internal circuit from each other if the first plug is connected to the first receptacle.

According to this embodiment, there is provided a technique for restricting simultaneous use of the two receptacles.

6. In the electric device of each of the above embodiments, the electric device comprises a power generator, the first receptacle is a receptacle (for example, 2) with which another power generator is connected in series, and the second receptacle is a receptacle (for example, 3) to which an electric load is connected.

According to this embodiment, use of a plurality of power supply routes can be restricted.

7. A wiring cable (for example, 10) of each of the above embodiments is a wiring cable connected to an electric device (for example, 1A, 1B), wherein the electric device comprises a first receptacle (for example, 2) to which a first plug is connected, a second receptacle (for example, 3) to which a second plug is connected, and a cover member (for example, 4) configured to open/close the second receptacle, in a state in which the first plug is connected to the first receptacle, opening of the cover member is restricted by interference between the first plug and the cover member, and in a state in which the second plug is connected to the second receptacle, connection of the first plug to the first receptacle is restricted by interference between the first plug and the cover member, and the wiring cable comprises a first plug (for example, 12), the first plug includes a projecting portion (for example, 12*a*) projecting in a direction crossing a connection direction of the first plug with respect to the first receptacle, the cover member is supported pivotally about a pivotal shaft (for example, 4*a*) in a direction along a wall surface (for example, 1*c*) on which the second receptacle is arranged, and the projecting portion is located on a pivotal locus of the cover member in a state in which the first plug is connected to the first receptacle.

According to this embodiment, there is provided a technique for restricting simultaneous use of the two receptacles. The pivotal motion of the cover member can be restricted by the projecting portion. Insertion/removal of the first plug can be restricted by the pivotal position of the cover member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An electric device comprising:

a first receptacle to which a first plug is connected;

a second receptacle to which a second plug is connected; and a cover member configured to open/close the second receptacle, wherein in a state in which the first plug is connected to the first receptacle, opening of the cover member is restricted by interference between the first plug and the cover member, in a state in which the second plug is connected to the second receptacle, connection of the first plug to the first receptacle is restricted by interference between the first plug and the cover member, the electric device comprises a power generator, the first receptacle is a receptacle with which another power generator is connected in series, and the second receptacle is a receptacle to which an electric load is connected.

2. The device according to claim 1, wherein the cover member is supported to be displaceable between a position where the cover member covers the second receptacle but does not cover the first receptacle and a position where the cover member covers the first receptacle but does not cover the second receptacle.

3. The device according to claim 2, wherein the cover member is supported to be slidable in a direction along a wall surface on which the first receptacle and the second receptacle are arranged.

4. An electric device comprising:

a first receptacle to which a first plug is connected;

a second receptacle to which a second plug is connected; and a cover member configured to open/close the second receptacle, wherein in a state in which the first plug is connected to the first receptacle, opening of the cover member is restricted by interference between the first plug and the cover member, in a state in which the second plug is connected to the second receptacle, connection of the first plug to the first receptacle is restricted by interference between the first plug and the cover member, the first plug includes a projecting portion projecting in a direction crossing a connection direction of the first plug with respect to the first receptacle, the cover member is pivotally supported around a pivotal shaft in a direction along a wall surface on which the second receptacle is arranged, and the projecting portion is located on a pivotal locus of the cover member in a state in which the first plug is connected to the first receptacle.

5. The device according to claim 4, wherein the electric device comprises a power generator, the first receptacle is a receptacle with which another power generator is connected in series, and the second receptacle is a receptacle to which an electric load is connected.

* * * * *